United States Patent [19]

Strugatz

[11] 4,061,514

[45] Dec. 6, 1977

[54] PROCESS FOR MASS-PRODUCING WORKS OF ART MADE FROM WOODEN STRIPS

[76] Inventor: Arthur Strugatz, 256 Asharoken Ave., Northport, N.Y. 11768

[21] Appl. No.: 760,086

[22] Filed: Jan. 17, 1977

[51] Int. Cl.[2] ..... B44C 1/28

[52] U.S. Cl. ..... 156/63; 156/91; 156/256; 428/33; 428/50; 428/67

[58] Field of Search ..... 156/63, 91, 264, 256, 156/258; 428/33, 67, 50

[56] References Cited

U.S. PATENT DOCUMENTS

| | | | |
|---|---|---|---|
| 1,153,424 | 9/1945 | Johst et al. | 156/63 |
| 1,813,901 | 7/1931 | Bayne | 156/63 |
| 2,162,610 | 6/1939 | Dinsmore | 156/63 |
| 2,747,298 | 5/1956 | Sullivan | 428/187 |
| 3,438,840 | 4/1969 | George | 156/63 |

*Primary Examiner*—Edward G. Whitby

*Attorney, Agent, or Firm*—Brumbaugh, Graves, Donohue & Raymond

[57] ABSTRACT

Works of art made from strips of material, preferably wooden lath strips, are mass-produced by sawing the lath strips to the desired size of the art work, painting or staining the sawed pieces to the desired color or shade, dye-stamping the stained or cut strips to their final shape, assembling the shaped pieces into the final design or picture of the art work, and fixing, by nailing, stapling, or glueing, the assembled pieces to a suitable backing. Preferably, the same strips of material are used to form the frame and side supports for the final product.

5 Claims, No Drawings

PROCESS FOR MASS-PRODUCING WORKS OF ART MADE FROM WOODEN STRIPS

This invention relates to forming works of art on a mass-production basis. More particularly, the invention described and claimed herein relates to a novel process of mass-producing works of art from ordinary wooden lath strips in the form of any design or picture to be framed and hung.

In the past, it would have been necessary in making a framed picture from wooden lath strips, to cut the strips carefully with a jigsaw both to the desired size and shape, paint or stain, then to assemble the pieces to a proper fit, which would perhaps require further shaping with the jigsaw, possible touching up and the fixing of the assembled pieces to some backing. The complications and tedious detail of such a technique, it will be readily appreciated, is most time-consuming and would never permit production on a large scale or mass-produced basis. To make works of art from lathing on this basis would be extremely costly, particularly for use of such art in restaurants, theatres, offices, and other public places where the cost of furnishings, such as wall pictures, is a significant factor.

Accordingly, it is the object of this invention to provide a novel assembly system or process for mass-producing aesthetically pleasing works of art from ordinary wooden lath strips on an efficient and economical basis.

I have discovered that works of art may be mass-produced from strips of material, and preferably from wooden lath strips, according to the following process steps: (1) predetermining the number, size, and shape of the lath strips required for the selected final design or picture in the quantity desired; (2) cutting, for example, by sawing, the proper number of latch strips to the necessary sizes, including, preferably, lath strips for the frame and side supports; (3) painting or staining the various cut pieces to the desired color or shades; (4) dye-stamping the colored pieces to the proper shapes; (5) assembling the shaped pieces into the selected design or picture; and (6) fixing, such as by glueing, stapling, or nailing, the assembled pieces to a suitable backing. The assembled design or picture on the backing may then be framed with additional lath strips or any other appropriate framing structure. It has been found that the foregoing process not only permits an efficient and economical method of mass-producing art works of wooden lathing, but that the art obtained has a satisfactory and pleasing aesthetic value.

Prior to any actual use of the process for mass-production of final art works, a number of factors must be determined, namely, (1) the overall view of the final design or picture; (2) the size of the final picture which will predetermine the size and number of lath strips to be used per art work; (3) the color or stain to be assigned to each piece; and (4) the shape of each piece such that the press for dye-stamping the pieces may be constructed. Once all these factors have been predetermined, the process may be employed in an efficient manner to produce a maximum number of art works at minimum cost.

While the process according to the invention is specifically designed for the production of art work made from ordinary lath strips, it will be readily seen by those skilled in the art that any similar material may be used for the process. For example, other types of soft wood stripping which may be dye-stamped, and also plastics which can be cut and shaped on a mass-production basis, are contemplated.

With respect to the type of paint or stain which can be used, this is purely a matter of choice and is dictated only by the type and variety of final art work desired.

A crucial part of the process involves the dye-stamping operation which may be carried out with any suitable dye and press apparatus, various kinds of which are well-known in the industry.

Any kind of backing member may be used to mount the assembled pieces of lath strips. The backing should preferably be rigid and lightweight. The backing may be plywood, composition, or even some lightweight rigid plastic sheet. It may be seen that depending upon the back, the pieces may be fixed to it by nailing, stapling, glueing, or any other appropriate fixing means.

While the invention has been particularly described with several specific and preferred embodiments, it will be apparent to those skilled in the art that the principles embodied in this invention encompass many embodiments as defined by the scope of the following claims.

I claim:

1. A process for mass-producing works of art fabricated from strips of material comprises:

a. predetermining the number, size, and shape of the strips required to achieve the desired final design or picture of the work of art;

b. cutting the proper number of lath strips to the sizes necessary for making the final design or picture;

c. painting or staining the cut pieces to the desired color or shade for the final design or picture;

d. dye-stamping the cut pieces to the proper shape for forming the final design or picture;

e. assembling the shaped pieces into the final design or picture; and f. fixing the assembled pieces to a suitable backing.

2. A process, according to claim 1, wherein the strips of material are wooden lath strips.

3. A process, according to claim 1, wherein the process includes cutting and assembly of the strips for the frame and side supports for the final art work.

4. A process, according to claim 1, wherein the assembled strips are fixed to the backing by nailing, stapling, or glueing.

5. A process, according to claim 1, wherein the backing is rigid and lightweight.

* * * * *